US006598325B2

(12) United States Patent
Theurer et al.

(10) Patent No.: US 6,598,325 B2
(45) Date of Patent: Jul. 29, 2003

(54) MACHINE AND METHOD FOR CLEARING BALLAST

(75) Inventors: Josef Theurer, Vienna (AT); Herbert Wörgötter, Gallneukirchen (AT)

(73) Assignee: Franz Plasser Bahnbaumaschinen Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/045,854

(22) Filed: Jan. 11, 2002

(65) Prior Publication Data

US 2002/0100191 A1 Aug. 1, 2002

(30) Foreign Application Priority Data

Jan. 29, 2001 (AT) ..... GM 69/2001

(51) Int. Cl.[7] ..... E02F 5/22

(52) U.S. Cl. ..... 37/104; 37/106; 37/105; 104/7.3

(58) Field of Search ..... 37/104, 105, 106; 104/7.3, 7.2, 7.1, 9, 6

(56) References Cited

U.S. PATENT DOCUMENTS 3,877,160 A * 4/1975 Plasser et al. ..... 37/105
4,196,532 A * 4/1980 Muller ..... 37/105
4,266,351 A * 5/1981 Cox ..... 37/104
4,951,573 A * 8/1990 Madison ..... 104/9
5,046,270 A 9/1991 Theurer et al.
5,101,733 A * 4/1992 Mohr ..... 104/12
5,125,345 A 6/1992 Theurer et al.
5,320,045 A * 6/1994 Theurer ..... 104/2
5,926,981 A * 7/1999 Theurer ..... 37/104

FOREIGN PATENT DOCUMENTS

JP 06033401 * 2/1994

* cited by examiner

*Primary Examiner*—Thomas B. Will
*Assistant Examiner*—Thomas A. Beach
(74) *Attorney, Agent, or Firm*—Collard & Roe, P.C.

(57) ABSTRACT

A mobile machine for clearing ballast from a ballast bed section wherefrom a tie has been removed comprises a machine frame extending in a longitudinal direction, undercarriages supporting the machine frame for mobility on a track supported on the ballast bed, and a ballast clearing device vertically adjustably mounted on the machine frame for clearing ballast from the ballast bed section. The ballast clearing device comprises an inner ballast clearing element arranged on the gage side of at least one rail and pivotal by a pivoting drive in a plane extending transversely to the longitudinal direction about an axis extending in the longitudinal direction, and an outer ballast clearing element vertically adjustable by a vertical adjustment drive independent of the inner ballast clearing element and arranged on the field side of the rail.

9 Claims, 2 Drawing Sheets

MACHINE AND METHOD FOR CLEARING BALLAST

BACKGROUND OF THE INVENTION

1. Field of the Invention

The present invention relates to a mobile machine for clearing ballast from a ballast bed section wherefrom a tie has been removed, which comprises a machine frame extending in a longitudinal direction, undercarriages supporting the machine frame for mobility on a track supported on the ballast bed, the track comprising two rails having a field side and a gage side, and a ballast clearing device vertically adjustably mounted on the machine frame for clearing ballast from the ballast bed section, the ballast clearing device comprising inner ballast clearing elements on the gage side of the rails and outer ballast clearing elements on the field side of the rails.

The invention also relates to an improved method for clearing ballast from a ballast section wherefrom a tie has been removed.

2. Description of the Prior Art

A machine of this type has been disclosed in U.S. Pat. No. 5,125,345. In this machine, the ballast clearing is combined with a tie exchange and tamping of the newly inserted tie. The ballast clearing device comprises two pairs of ballast clearing elements, each pair being associated with one of the rails and being lowered into the ballast bed after an old tie has been removed. Each pair of ballast clearing elements is then transversely moved to displace parts of the ballast to the track shoulder.

Another machine of this type has been disclosed in U.S. Pat. No. 5,046,270.

SUMMARY OF THE INVENTION

It is the primary object of this invention to provide such a ballast clearing machine and method with an improved efficiency.

This object is accomplished according to the invention with a mobile machine of the first-described type, wherein the ballast clearing device comprises an inner ballast clearing element arranged on the gage side of at least one rail and pivotal by a pivoting drive in a plane extending transversely to the longitudinal direction about an axis extending in the longitudinal direction, and an outer ballast clearing element vertically adjustable by a vertical adjustment drive independent of the inner ballast clearing element and arranged on the field side of the rail.

This simple structure of the ballast clearing device makes it possible to displace the ballast underneath the rail to its field side and towards the outer ballast clearing element, which is then enabled to displace the cleared ballast towards the track shoulder. The independent vertical adjustment of the inner and outer ballast clearing elements assures the sequential operation of the two ballast clearing elements in an advantageous manner.

The invention accordingly provides an improved method for clearing ballast from a ballast bed section wherefrom a tie has been removed, the ballast bed supporting a track comprising two rails having a field side and a gage side, which comprises clearing ballast from the ballast bed section by first clearing a part of the ballast by lowering an inner ballast clearing element carrying a ballast clearing plate into the ballast, the inner ballast clearing element being arranged on the gage side of the rail, and pivoting the inner ballast clearing element in a plane extending transversely to the longitudinal direction about an axis extending in the longitudinal direction until the ballast clearing plate has displaced said ballast part towards the field side of the rail, and then lowering an outer ballast clearing element arranged on the field side of the rail and pivoting the outer ballast clearing element to displace the ballast towards a ballast bed shoulder.

In this method, efficient ballast clearing is obtained in a relative short operating cycle, providing a rapid clearing of the ballast underneath the rails and removal of the cleared ballast to the ballast bed shoulder.

BRIEF DESCRIPTION OF THE DRAWING

The above and other objects, advantages and features of the present invention will become more apparent from the following detailed description of certain now preferred embodiments thereof, taken in conjunction with the accompanying drawing wherein.

DETAILED DESCRIPTION OF THE PREFERRED EMBODIMENTS

Figure 1:
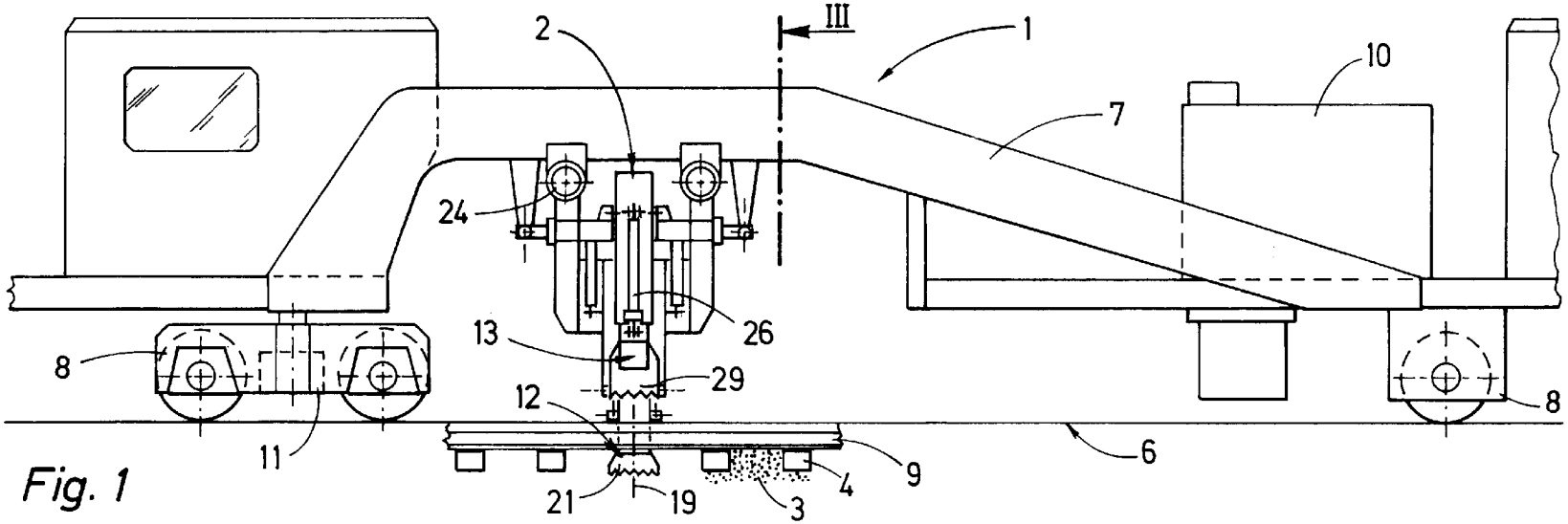
FIG. 1 is a simplified side elevational view of a machine according to this invention.
Figure 2:
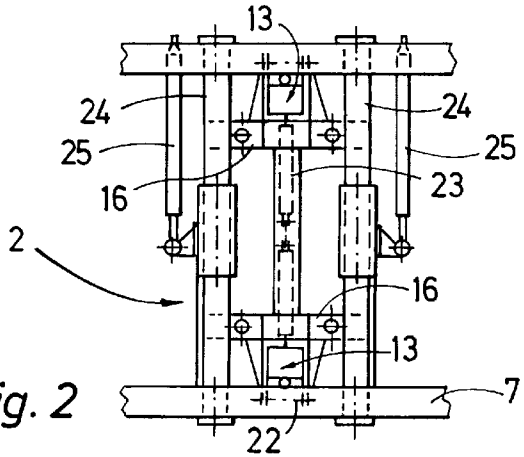
FIG. 2 is a top view of a portion of the machine of FIG. 1, showing the ballast clearing device.
Figure 3:
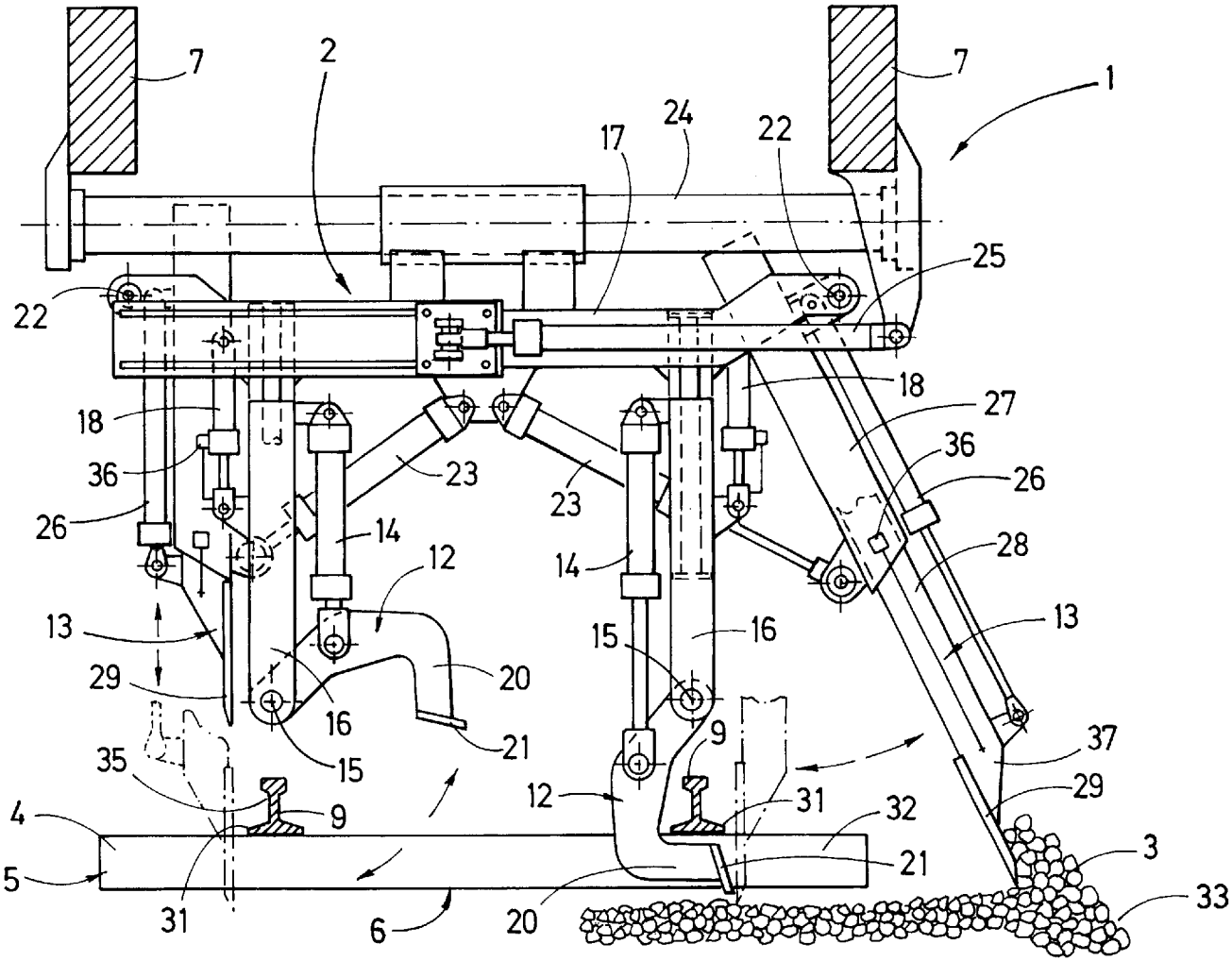
FIG. 3 is an enlarged end view of the ballast clearing device, taken in the direction of arrow III in FIG. 1.

Referring now to the drawing and more particularly to FIGS. 1 to 3, there is shown mobile machine 1 for clearing ballast 3 from a ballast bed section 5 wherefrom a tie 4 has been removed. The machine comprises machine frame 7 extending in a longitudinal direction, undercarriages 8 supporting the machine frame for mobility on track 6 supported on the ballast bed, the track comprising two rails 9 having a field side 35 and a gage side. Power plant 10 provides power to the various drives, including motor 11 driving machine 1 along track 6.

As best shown in FIG. 3, a ballast clearing device 2 is vertically adjustably mounted on machine frame 7 for clearing ballast from the ballast bed section. This ballast clearing device comprises an inner ballast clearing element 12 arranged on the gage side of rails 9 and pivotal by pivoting drive 14 in plane 19 (see FIG. 1) extending transversely to the longitudinal direction about axis 15 extending in the longitudinal direction, and outer ballast clearing element 13 arranged on field side 35 of rail 9 and vertically adjustable by vertical adjustment drive 26 independent of inner ballast clearing element 12.

In the illustrated embodiment, a first carrier body 17 is adjustable transversely to the longitudinal direction, and each inner ballast clearing element 12 is mounted on a second carrier body 16. A drive 18 vertically adjustably affixes the second carrier body to the first carrier body. The inner ballast clearing elements are arranged in pivoting plane 19 on the gage side of each rail 9. Axes 15 about which inner ballast clearing elements 12 are pivotal are spaced from each other in plane 19 a distance corresponding approximately to the track gage.

Each outer ballast clearing element 13 comprises two telescoping tubes 27, 28 adjustable relative to each other in a longitudinal direction. First tube 27 is pivotally mounted on first carrier body 17 for pivoting about axis 22 extending in the longitudinal direction, and second tube 28 has ballast clearing plate 29 affixed to an outer end thereof. Pivoting drive 23 is connected to first tube 27 for pivoting the outer ballast clearing element about axis 22.

First carrier body 17 is mounted on transversely extending guide rails 24 affixed to machine frame 7 so that transverse adjustment drive 25 may transversely adjust ballast clearing device 2. The transverse adjustment of ballast clearing device 2 by operation of drive 25 enables the device to be properly centered in track curves by positioning pivoting axes 15 in vertical alignment with rails 9.

As clearly shown in FIG. 3, the inner ballast clearing element has an angular end section 20 extending in the pivoting plane 19 and being positioned underneath rail 9 in a pivotal end position shown at the right rail in FIG. 3, i.e. when the inner ballast clearing element has been lowered into the ballast. Ballast clearing plate 21 extending in the longitudinal direction is affixed to end section 20, the ballast clearing plate facing outwardly.

Figure 4:
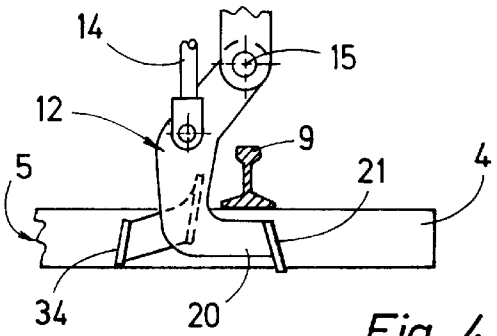
FIG. 4 shows a modified embodiment of the inner ballast clearing element.

In the modified embodiment shown in FIG. 4, a further ballast clearing plate 34 is affixed to inner ballast clearing element 12 and faces inwardly towards the center of track 6.

To monitor the vertical adjustment, a device 36 for monitoring the vertical adjustment path of the ballast clearing device relative to machine frame 7 may be provided.

Machine 1 operates in the following manner:

Before ballast is cleared from a ballast bed section 5 wherefrom a tie 4 has been removed, ballast clearing elements 12, 13 are maintained in their raised rest position shown in the left half of FIG. 3 in full lines. A part of ballast 3 is first cleared by lowering inner ballast clearing elements 12 carrying ballast clearing plate 21 into the ballast by actuating drives 18 and pivoting the inner ballast clearing element by actuating drives 14 in plane 19 about axes 15 until the ballast clearing plates have displaced this ballast part towards the field side of the rails to outer edge 31 of the foot of rail 9 (see right half of FIG. 3). This completely moves this ballast from underneath rails 9 to the field side portion 32 of the ballast bed section 5. Immediately thereafter, outer ballast clearing elements 13 are lowered by actuating drives 26 so that the outer ballast clearing elements assume the operating position indicated in phantom lines at the left side of FIG. 3. In this position, ballast clearing plate 29 is located immediately adjacent field side 35 of rail 9. Pivoting drives 23 are now actuated to pivot the outer ballast clearing elements in the manner illustrated on the right side of FIG. 3 to displace ballast 3 towards ballast bed shoulder 33.

As outer ballast clearing elements 13 are operated, inner ballast clearing elements 12 may be pivoted upwardly by actuating drives 14. At the end of a ballast clearing cycle, outer ballast clearing elements 13 are raised into their rest position. Machine 1 may then be driven to the next ballast bed section 5 to be cleared.

When inner ballast clearing elements 12 are provided with additional ballast clearing plates 34, as shown in the modified embodiment illustrated in FIG. 4, a central portion of ballast bed portion 5 may be cleared in an extended clearing cycle. In this case, one of the inner ballast clearing elements is raised into its inoperative position after the above-described operating cycle has been completed (for example the inner ballast clearing element on the left, as shown in FIG. 3), and ballast clearing device 2 is moved to the left by actuating transverse adjustment drive 25. In this way, any encrusted ballast in the center of track 6 may be cleared with ballast clearing plate 34 of lowered inner ballast clearing element 12 at the right.

The operating cycles are automated and may be started by an operator at a control panel on machine 1. Monitoring device 36 enables the vertical and transverse adjustments of the ballast clearing elements to be accurately controlled. Depending on the ballast condition and particularly if the ballast is relatively loose, it may be sufficient to operate only outer ballast clearing elements 13.

What is claimed is:

1. A mobile machine for clearing ballast from a ballast bed section wherefrom a tie has been removed, which comprises (a) a machine frame extending in a longitudinal direction, (b) undercarriages supporting the machine frame for mobility on a track supported on the ballast bed, the track comprising two rails having a field side and a gage side, and (c) a ballast clearing device vertically adjustably mounted on the machine frame for clearing ballast from the ballast bed section, the ballast clearing device comprising (1) an inner ballast clearing element arranged on the gage side of at least one rail and pivotal by a pivoting drive in a plane extending transversely to the longitudinal direction about an axis extending in the longitudinal direction, and (2) an outer ballast clearing element vertically adjustable by a vertical adjustment drive independent of the inner ballast clearing element and arranged on the field side of the rail.

2. The machine of claim 1, comprising a first carrier body which is adjustable transversely to the longitudinal direction, a second carrier body, the inner ballast clearing element being mounted on the second carrier body, and a drive for vertically adjustably affixing the second carrier body to the first carrier body.

3. The machine of claim 2, wherein a respective one of said inner ballast clearing elements is arranged in the pivoting plane on the gage side of each rail, each inner ballast clearing element being mounted on a respective one of said second carrier bodies and the second carrier bodies being vertically adjustably affixed to the first carrier body.

4. The machine of claim 3, wherein the axes about which the inner ballast clearing elements are pivotal are spaced from each other in said plane a distance corresponding approximately to the track gage.

5. The machine of claim 2, wherein the outer ballast clearing element comprises two telescoping tubes adjustable relative to each other in a longitudinal direction, a first one of the tubes being pivotally mounted on the first carrier body for pivoting about an axis extending in the longitudinal direction, and a second one of the tubes having a ballast clearing plate affixed to an outer end thereof.

6. The machine of claim 1, wherein the inner ballast clearing element has an angular end section extending underneath the rail in a pivotal end position, and a ballast clearing plate extending in the longitudinal direction is affixed to the end section, the ballast clearing plate facing outwardly.

7. The machine of claim 6, comprising a further ballast clearing plate affixed to the inner ballast clearing element and facing inwardly.

8. The machine of claim 1, further comprising a device for monitoring the vertical adjustment path of the ballast clearing device relative to the machine frame.

9. A method for clearing ballast from a ballast bed section wherefrom a tie has been removed, the ballast bed supporting a track comprising two rails having a field side and a gage side, which comprises clearing ballast from the ballast bed section by (a) first clearing a part of the ballast by lowering an inner ballast clearing element carrying a ballast clearing plate into the ballast, the inner ballast clearing element being arranged on the gage side of the rail, and pivoting the inner ballast clearing element in a plane extending transversely to the longitudinal direction about an axis extending in the longitudinal direction until the ballast clearing plate has displaced said ballast part towards the field side of the rail, and (b) then lowering an outer ballast clearing element arranged on the field side of the rail and pivoting the outer ballast clearing element to displace the ballast towards a ballast bed shoulder.

* * * * *